US011391197B1

(12) United States Patent
Park et al.

(10) Patent No.: US 11,391,197 B1
(45) Date of Patent: Jul. 19, 2022

(54) PISTON COOLING APPARATUS OF ENGINE AND METHOD FOR CONTROLLING THE SAME

(71) Applicants: Hyundai Motor Company, Seoul (KR); Kia Corporation, Seoul (KR)

(72) Inventors: Tae Won Park, Incheon (KR); Duk Jin Park, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/530,698

(22) Filed: Nov. 19, 2021

(30) Foreign Application Priority Data

May 25, 2021 (KR) ..... 10-2021-0067162

(51) Int. Cl.

| | |
|---|---|
| ***F01P 3/08*** | (2006.01) |
| ***F01M 1/16*** | (2006.01) |
| ***F01M 1/08*** | (2006.01) |
| ***F01P 7/14*** | (2006.01) |
| *F01P 3/00* | (2006.01) |

(52) U.S. Cl.
CPC ..... *F01P 3/08* (2013.01); *F01M 1/08* (2013.01); *F01M 1/16* (2013.01); *F01P 7/14* (2013.01); *F01P 2003/006* (2013.01); *F01P 2007/146* (2013.01); *F01P 2023/08* (2013.01)

(58) Field of Classification Search
CPC ..... F01P 7/14; F01P 3/08; F01M 1/08; F01M 1/06
See application file for complete search history.

(56) References Cited

U.S. PATENT DOCUMENTS

| | | | | |
|---|---|---|---|---|
| 2008/0078339 | A1* | 4/2008 | Obermeier | F01P 3/08 123/41.35 |
| 2014/0100765 | A1* | 4/2014 | Maki | F01P 3/08 701/113 |
| 2016/0186642 | A1* | 6/2016 | Honda | F01P 3/08 123/41.35 |
| 2017/0350304 | A1* | 12/2017 | Yamashita | F02F 3/22 |

FOREIGN PATENT DOCUMENTS

| | | | |
|---|---|---|---|
| KR | 102008058739 A | * | 6/2008 |
| KR | 101734771 B1 | | 5/2017 |

* cited by examiner

*Primary Examiner* — Kevin A Lathers
(74) *Attorney, Agent, or Firm* — Fox Rothschild LLP

(57) ABSTRACT

A piston cooling apparatus of an engine and a method for controlling the same are provided. The piston cooling apparatus includes a piston cooling jet that has a first nozzle configured to spray oil towards an inner wall of a cylinder configured such that a piston reciprocates thereon, and a second nozzle configured to spray the oil towards the lower part of the piston. A jet control valve is installed to adjust a hydraulic pressure that is supplied from an oil pump to the piston cooling jet. A controller is configured to operate the jet control valve and adjust the hydraulic pressure discharged from the oil pump.

11 Claims, 2 Drawing Sheets

PISTON COOLING APPARATUS OF ENGINE AND METHOD FOR CONTROLLING THE SAME

CROSS-REFERENCE TO RELATED APPLICATION

This application claims priority from Korean Patent Application No. 10-2021-0067162, filed on May 25, 2021, the disclosure of which is incorporated herein by reference in its entirety.

BACKGROUND

1. Field of the Disclosure

The present disclosure relates to technology that cools the piston of an engine.

2. Description of the Related Art

The pistons of an engine convert force from explosive energy of gas generated in a combustion chamber into mechanical power, must reciprocate in respective cylinders at a high speed while constituting a part of the combustion chamber, and thus essentially requires proper cooling and lubrication. Cooing and lubrication of the piston are mainly performed by engine oil (hereinafter, referred to simply as "oil"), and an oil jet configured to spray the oil onto the lower part of the piston may effectively facilitate cooling and lubrication of the piston.

However, the engine may be operated in various driving states, such as a start state, a high load state, a high rotation state, etc., and the pistons require different cooling performances in these various driving states. There are many devices which are operated using the hydraulic pressure of the oil, such as a variable valve timing (VVT) device, in the engine and, in consideration of effective and appropriate use of the hydraulic pressure of the oil, it is not enough for the oil jet to spray the oil towards the piston.

The above information disclosed in the Background section is only for enhancement of understanding of the background of the disclosure and should not be interpreted as conventional technology that is already known to those skilled in the art.

SUMMARY

Therefore, the present disclosure has been made in view of the above problems, and it is an object of the present disclosure to provide a piston cooling apparatus of an engine and a method for controlling the same, which may facilitate cooling and lubrication of a piston using an oil jet, may effectively control the oil sprayed through the oil jet based on the driving state of an engine to prevent scuffing of the piston and to secure sufficient responsiveness of a VVT device, may reduce contaminants discharged from the engine, particularly, reduce a particle number (PN), and may reduce knocking and protect the piston in the high load state or the high rotation state of the engine.

In accordance with an aspect of the present disclosure, the above and other objects may be accomplished by a piston cooling apparatus of an engine, the piston cooling apparatus may include a piston cooling jet having a first nozzle configured to spray oil towards an inner wall of a cylinder configured such that a piston reciprocates thereon, and a second nozzle configured to spray the oil towards the lower part of the piston, a jet control valve installed to adjust a hydraulic pressure supplied from an oil pump to the piston cooling jet, and a controller configured to operate the jet control valve and adjust the hydraulic pressure discharged from the oil pump, wherein the first nozzle and the second nozzle are opened by a pressure of the oil supplied to the piston cooling jet, and a pressure of the oil to open the first nozzle and a pressure of the oil to open the second nozzle are different.

The pressure of the oil to open the first nozzle may be set to be lower than the pressure of the oil to open the second nozzle, and thereby, as the pressure of the oil supplied to the piston cooling jet is increased, the first nozzle may be first opened and thereafter the second nozzle may be opened together with the first nozzle. The controller may be configured to operate an oil pump control valve to adjust the hydraulic pressure discharged from the oil pump.

The controller may be configured to operate the oil pump control valve to adjust the hydraulic pressure discharged from the oil pump to reach the pressure of the oil to open the first nozzle, and open the jet control valve so that the piston cooling jet sprays the oil through only the first nozzle, for a designated initial reference time when the engine is started to prevent scuffing of the piston and to limit cooling of the piston. The controller may be configured to operate the oil pump control value to adjust the hydraulic pressure discharged from the oil pump to reach a pressure sufficient to smoothly operate a VVT device, and may close the jet control valve, when the VVT device is operated.

Additionally, the controller may be configured to operate the oil pump control valve to adjust the hydraulic pressure discharged from the oil pump t reach the pressure of the oil to open the second nozzle, and open the jet control valve so that the piston cooling jet sprays the oil through both the first nozzle and the second nozzle, when the engine is in a designated high load or high rotation state, to prevent scuffing of the piston and to cool the piston. The controller may be configured to operate the piston cooling jet to spray the oil through the first nozzle for a designated basic spray time, when a designated pause time elapses after the piston cooling jet sprays the oil during driving of the engine.

In accordance with another aspect of the present disclosure, a method for controlling a piston cooling apparatus of an engine may include operating an oil pump to adjust a hydraulic pressure discharged from the oil pump to reach a pressure to open a first nozzle but not to open a second nozzle of a piston cooling jet for a designated initial reference time, when the engine is started, and opening a jet control valve configured to adjust a flow path from the oil pump to the piston cooling jet for the initial reference time.

The method may further include determining whether a VVT device of the engine is operated, and operating the oil pump to adjust the hydraulic pressure discharged from the oil pump to reach a pressure sufficient to smoothly operate the VVT device, and closing the jet control valve, in response to determining that the VVT device is operated. The method may further include determining whether the engine is in a designated high load or high rotation state, and operating the oil pump to adjust the hydraulic pressure discharged from the oil pump to reach a pressure sufficient to open the second nozzle, and opening the jet control valve so that the piston cooling jet sprays the oil through both the first nozzle and the second nozzle, in response to determining that the engine is in the high load or high rotation state.

The method may further include determining whether a designated pause time elapses after the piston cooling jet sprays the oil during driving of the engine, and operating the oil pump and the jet control valve so that the piston cooling jet sprays the oil through the first nozzle for a designated basic spray time, in response to determining that the pause time elapses.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
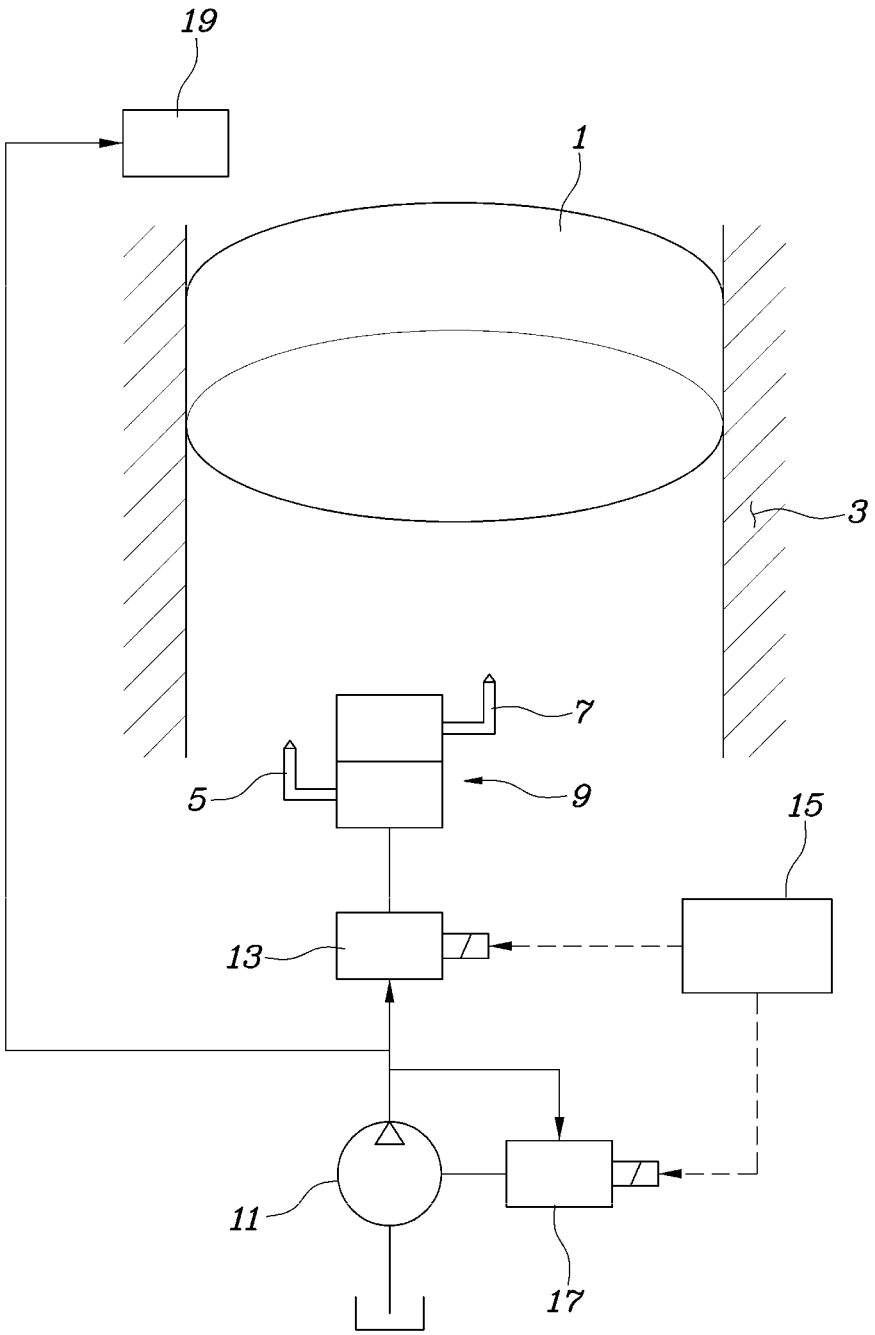
FIG. 1 is a schematic view illustrating a piston cooling apparatus of an engine according to one embodiment of the present disclosure.

Specific structural or functional descriptions in embodiments of the present disclosure set forth in the description which follows will be exemplarily given to describe the embodiments of the present disclosure. However, the present disclosure may be embodied in many alternative forms, and should not be construed as being limited to the embodiments set forth herein.

The embodiments of the present disclosure may be variously modified and changed, and thus specific embodiments of the present disclosure will be illustrated in the drawings and described in detail in the following description of the embodiments of the present disclosure. However, it will be understood that the embodiments of the present disclosure are provided only to completely disclose the disclosure and cover modifications, equivalents or alternatives which come within the scope and technical range of the disclosure.

In the following description of the embodiments, terms, such as "first" and "second", are used only to describe various elements, and these elements should not be construed as being limited by these terms. These terms are used only to distinguish one element from other elements. For example, a first element described hereinafter may be termed a second element, and similarly, a second element described hereinafter may be termed a first element, without departing from the scope of the disclosure.

When an element or layer is referred to as being "connected to" or "coupled to" another element or layer, it may be directly connected or coupled to the other element or layer, or intervening elements or layers may be present. In contrast, when an element or layer is referred to as being "directly connected to" or "directly coupled to" another element or layer, there may be no intervening elements or layers present. Other words used to describe relationships between elements should be interpreted in a like fashion, e.g., "between" versus "directly between," "adjacent" versus "directly adjacent," etc.

The terminology used herein is for the purpose of describing particular embodiments only and is not intended to be limiting. As used herein, singular forms may be intended to include plural forms as well, unless the context clearly indicates otherwise. The terms "comprises," "comprising," "including," and "having" are inclusive and therefore specify the presence of stated features, integers, steps, operations, elements, components, and/or combinations thereof, but do not preclude the presence or addition of one or more other features, integers, steps, operations, elements, components, and/or combinations thereof.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless defined otherwise, all terms including technical and scientific terms used in the following description have the same meanings as those of terms generally understood by those skilled in the art. Terms defined in generally used dictionaries will be interpreted as having meanings coinciding with contextual meanings in the related technology, and are not to be interpreted as having ideal or excessively formal meanings unless defined clearly in the description.

Hereinafter, reference will be made in detail to various embodiments of the present disclosure, examples of which are illustrated in the accompanying drawings and described below. In the drawings, the same or similar elements are denoted by the same reference numerals even when they are depicted in different drawings.

Referring to FIG. 1, a piston cooling apparatus of an engine according to one embodiment of the present disclosure may include a piston cooling jet including a first nozzle 5 configured to spray oil towards an inner wall 3 of a cylinder, on which a piston 1 reciprocates, and a second nozzle 7 configured to spray the oil towards the lower part of the piston 1, a jet control valve 13 installed to adjust a hydraulic pressure supplied from an oil pump 11 to the piston cooling jet 9, and a controller 15 configured to operate the jet control valve 13 and adjust the hydraulic pressure discharged from the oil pump 11.

The first nozzle 5 and the second nozzle 7 may be opened by the pressure of the oil supplied to the piston cooling jet 9, and the pressure of the oil to open the first nozzle 5 and the pressure of the oil to open the second nozzle 7 are different. In other words, the pressure of the oil to open the first nozzle 5 may be set to be lower than the pressure of the oil to open the second nozzle 7, and thus, as the pressure of the oil supplied to the piston cooling jet 9 is increased, the first nozzle 5 is first opened and thereafter the second nozzle 7 is opened together with the first nozzle 5. Therefore, a state in which the first nozzle 5 sprays the oil or a state in which both the first nozzle 5 and the second nozzle 7 spray the oil may be formed based on the pressure of the oil supplied to the piston cooling jet 9.

A valve, which is opened and closed based on the pressure of the oil supplied, as described above, may be connected to each of the first nozzle 5 and the second nozzle 7 in the piston cooling jet 9, and the valve connected to the second nozzle 7 may be opened at a higher pressure than the valve connected to the first nozzle 5. In this embodiment, the controller 15 may be configured to operate an oil pump control valve 17 to adjust the hydraulic pressure discharged from the oil pump 11.

In other words, when the controller 15 operates the oil pump control valve 17, a control pressure supplied to the oil pump 11 by the oil pump control valve 17 may be varied, and thus, the hydraulic pressure discharged from the oil pump 11 may be varied. Of course, when the oil pump 11 is not the above-described type, in which the hydraulic pressure discharged therefrom is varied based on the control pressure, but is an electric type, the controller 15 may be configured to directly operate the oil pump 11 without passing through the oil pump control valve 17.

For reference, the jet control valve 13 and the oil pump control valve 17 may be solenoid valves which are operated by an electrical control signal from the controller 25. The controller 15 may be configured to operate the oil pump control valve 17 to adjust the hydraulic pressure discharged from the oil pump 11 to reach the pressure of the oil to open only the first nozzle 5, and open the jet control valve 13 so that the piston cooling jet 9 sprays the oil through only the first nozzle 5, for a designated initial reference time when the engine is started to prevent scuffing of the piston 1 and to limit cooling of the piston 1. In other words, immediately after the engine is started, in a situation in which lubrication necessary for reciprocation of the piston 1 is required, the inner wall 3 of the cylinder may be lubricated with the oil sprayed through the first nozzle 5 of the piston cooling jet 9, and thus, smooth movement of the piston 1 is secured and scuffing of the piston 1 is prevented.

Further, the oil is not sprayed through the second nozzle 7, and thus, increase in a particle number (PN) i.e., the number of particles discharged from a combustion chamber, due to the low-temperature state of the piston 1 may be prevented. Therefore, the initial reference time may be set to a time appropriate to exhibit the above-described technical effects, may be set through a large number of experiments and analyses for each engine, and for example, may be set to 2 seconds after an engine is started.

The controller 15 may be configured to operate the oil pump control valve 17 to adjust the hydraulic pressure discharged from the oil pump 11 to reach a pressure sufficient to more smoothly operate a variable valve timing (VVT) device 19, and to close the jet control valve 13, when the VVT device 19 is operated. In other words, when the VVT device 19 is operated, a comparatively high hydraulic pressure of the oil is required for smooth operation of the VVT device 19, and thus, the controller 15 may be configured to operate the oil pump 11 to discharge a comparatively high hydraulic pressure through the oil pump control valve 17, and close the jet control valve 13 so that the oil discharged from the oil pump 11 is not sprayed through the first nozzle 5 or the second nozzle 7, thereby allowing the VVT device 19 to be more smoothly operated with the sufficient hydraulic pressure provided by the oil pump 11.

The controller 15 may be configured to operate the oil pump control valve 17 to adjust the hydraulic pressure discharged from the oil pump 11 to reach a pressure sufficient to open the second nozzle 7, and may be configured to open the jet control valve 13 so that both the first nozzle 5 and the nozzle 7 of the piston cooling jet 9 spray the oil in a designated high load or high rotation state of the engine, thereby being capable of preventing scuffing of the piston 1 and cooling the piston 1. In other words, when the thermal load of the engine is substantial due to the high load or high rotation state of the engine, the controller 15 may be configured to increase the hydraulic pressure discharged from the oil pump 11 and open the jet control valve 13 to cause both the first nozzle 5 and the nozzle 7 of the piston cooling jet 9 to spray the oil, thereby effectively performing lubrication of the piston 1, causing smooth movement of the piston 1, and cooling of the piston 1.

Therefore, since the thermal load of the engine is substantial in the high load or high rotation state of the engine, as described above, a state in which it is necessary to effectively perform lubrication between the piston 1 and the inner wall 3 of the cylinder and cooling of the piston 1 by spraying the oil through both the first nozzle 5 and the second nozzle 7 may be designedly determined through a large number of experiments and analyses. For example, the high load state of the engine may be set to a state in which the amount of depression of an accelerator pedal by a driver is equal to or greater than about 70%, and the high rotation state of the engine may be set to a state in which the RPM of the engine belongs to a red zone or is close to the red zone.

The controller 15 may be configured, when a designated pause time elapses after the piston cooling jet 9 sprays the oil, during driving of the engine, to operate the piston cooling jet 9 to spray the oil through the first nozzle 5 for a designated basic spray time. In other words, after the piston cooling jet 9 sprays the oil through the first nozzle 5, whenever the pause time elapses, the piston cooling jet 9 repeatedly sprays the oil through the first nozzle 5 so that the lubricated state of the inner wall 3 of the cylinder may continue to maintain a designated level or more.

Therefore, the pause time may be set based on a repetition of a cycle spray of the oil through the first nozzle 5 to prevent scuffing of the piston 1 and to secure more smooth movement state of the piston 1 due to the lubricated state of the inner wall 3 of the cylinder, and the basic spray time may be set based on an oil spray time that is advantageous in securing and maintaining the lubricated state of the inner wall 3 of the cylinder and in minimizing consumption of energy unnecessary for spray of the oil. For this purpose, the pause time may be set to about 30 seconds, the basic spray time may be set to about 1 second, and these times may be set to be appropriate for each engine through a large number of experiments and analyses.

Figure 2:
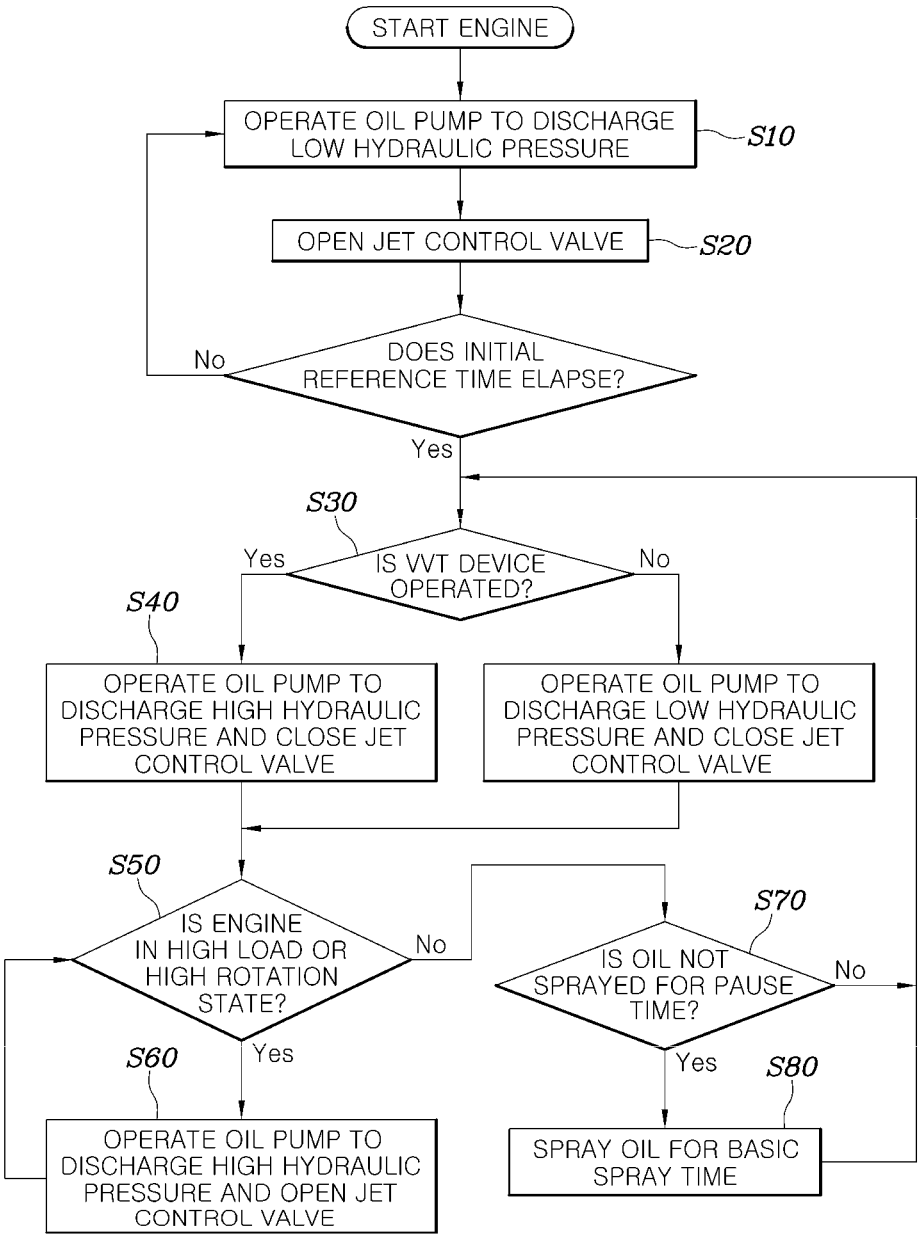
FIG. 2 is a flowchart illustrating a method for controlling a piston cooling apparatus of an engine according to one embodiment of the present disclosure.

Referring to FIG. 2, a method for controlling a piston cooling apparatus of an engine according to one embodiment of the present disclosure includes operating the oil pump 11 to adjust the hydraulic pressure discharged from the oil pump 11 to reach a pressure to open the first nozzle 5 but not to open the second nozzle 7 of the piston cooling jet 9 for a designated initial reference time, when the engine is started (S10), and opening the jet control valve 13 to adjust a flow path from the oil pump 11 to the piston cooling jet 9 for the initial reference time (S20). In other words, at the initial starting stage of the engine, as described above, the piston cooling jet 9 sprays the oil through only the first nozzle 5 to prevent scuffing of the piston 1 and to secure mobility of the piston 1 due to lubrication of the inner wall 3 of the cylinder.

The method according to this embodiment of the present disclosure may further include determining whether the VVT device 19 of the engine is operated (S30), and operating the oil pump 11 to adjust the hydraulic pressure discharged from the oil pump 11 to reach a high pressure sufficient to smoothly operate the VVT device 19, and closing the jet control valve 13, in response to determining that the VVT device 19 is operated (S40). In other words, when the VVT device 19 is operated, as described above, the hydraulic pressure discharged from the oil pump 11 is not consumed by the piston cooling jet 9 and is supplied to the VVT device 19, thereby securing smooth and stable operation of the VVT device 19. As a result of determination as to whether the VVT device 19 of the engine is operated, in response to determining that the VVT device 19 is not operated, the oil pump 11 may be operated to discharge a low pressure and the jet control valve 13 may be closed to minimize energy consumption, thereby enhancing fuel efficiency of a vehicle.

Further, the method according to this embodiment of the present disclosure may further include determining whether the engine is in a designated high load or high rotation state (S50), and operating the oil pump 11 to adjust the hydraulic pressure discharged from the oil pump 1 to reach a pressure sufficient to open the second nozzle 7 together with the first nozzle 1, and opening the jet control valve 13 so that the piston cooling jet 9 sprays the oil through both the first nozzle 5 and the second nozzle 7, in response to determining that the engine is in the high load or high rotation state (S60). In other words, in response to determining that the engine is in the designated high load or high rotation state in which the thermal load of the engine is great, the piston cooling jet 9 sprays the oil through both the first nozzle 5 and the second nozzle 7 to effectively perform lubrication between the piston 1 and the inner wall 3 of the cylinder and cooling of the piston 1.

In addition, the method according to this embodiment of the present disclosure may further include determining whether a designated pause time elapses after the piston cooling jet 9 sprays the oil during driving of the engine (S70), and operating the oil pump 11 and the jet control valve 13 to cause the piston cooling jet 9 to spray the oil through the first nozzle 5 for a designated basic spray time in response to determining that the pause time elapses (S80). In other words, the piston cooling jet 9 periodically sprays the oil towards the inner wall 3 of the cylinder, as described above, thereby maintaining a lubricated state between the piston 1 and the inner wall 3 of the cylinder in which the piston 1 may always smoothly reciprocate on the inner wall 3 of the cylinder.

As is apparent from the above description, a piston cooling apparatus of an engine and a method for controlling the same according to the present disclosure may facilitate cooling and lubrication of a piston using an oil jet, may effectively control the oil sprayed through the oil jet in consideration of the driving state of an engine to prevent scuffing of the piston and to secure sufficient responsiveness of a VVT device, may reduce contaminants discharged from the engine, particularly, reduce a particle number (PN), and may reduce knocking and protect the piston in the high load state or the high rotation state of the engine.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A piston cooling apparatus of an engine, comprising:

a piston cooling jet including a first nozzle configured to spray oil towards an inner wall of a cylinder configured such that a piston reciprocates thereon, and a second nozzle configured to spray the oil towards a lower part of the piston;

a jet control valve installed to adjust a hydraulic pressure supplied from an oil pump to the piston cooling jet; and a controller configured to operate the jet control valve and adjust the hydraulic pressure discharged from the oil pump, wherein the first nozzle and the second nozzle are opened by a pressure of the oil supplied to the piston cooling jet, and wherein a pressure of the oil to open the first nozzle and a pressure of the oil to open the second nozzle are different.

2. The piston cooling apparatus according to claim 1, wherein the pressure of the oil to open the first nozzle is set to be lower than the pressure of the oil to open the second nozzle, and as the pressure of the oil supplied to the piston cooling jet increases, the first nozzle is first opened and thereafter the second nozzle is opened together with the first nozzle.

3. The piston cooling apparatus according to claim 1, wherein the controller is configured to operate an oil pump control valve to adjust the hydraulic pressure discharged from the oil pump.

4. The piston cooling apparatus according to claim 3, wherein the controller is configured to operate the oil pump control valve to adjust the hydraulic pressure discharged from the oil pump to reach the pressure of the oil to open the first nozzle, and open the jet control valve so that the piston cooling jet sprays the oil through only the first nozzle, for a designated initial reference time when the engine is started to prevent scuffing of the piston and to limit cooling of the piston.

5. The piston cooling apparatus according to claim 3, wherein the controller is configured to operate the oil pump control value to adjust the hydraulic pressure discharged from the oil pump to reach a pressure sufficient to smoothly operate a variable valve timing (VVT) device, and closes the jet control valve, when the VVT device is operated.

6. The combustion control apparatus according to claim 3, wherein the controller is configured to operate the oil pump control valve to adjust the hydraulic pressure discharged from the oil pump to reach the pressure of the oil to open the second nozzle, and open the jet control valve so that the piston cooling jet sprays the oil through both the first nozzle and the second nozzle, when the engine is in a designated high load or high rotation state, to prevent scuffing of the piston and to cool the piston.

7. The combustion control apparatus according to claim 3, wherein the controller is configured to operate the piston cooling jet to spray the oil through the first nozzle for a designated basic spray time, when a designated pause time elapses after the piston cooling jet sprays the oil during driving of the engine.

8. A method for controlling a piston cooling apparatus of an engine, comprising:

operating, by a controller, an oil pump to adjust a hydraulic pressure discharged from the oil pump to reach a pressure to open a first nozzle but not to open a second nozzle of a piston cooling jet for a designated initial reference time, when the engine is started; and opening, by the controller, a jet control valve configured to adjust a flow path from the oil pump to the piston cooling jet for the initial reference time.

9. The method according to claim 8, further comprising:

determining, by the controller, whether a variable valve timing (VVT) device of the engine is operated; and operating, by the controller, the oil pump to adjust the hydraulic pressure discharged from the oil pump to reach a pressure sufficient to more smoothly operate the VVT device, and closing the jet control valve, in response to determining that the VVT device is operated.

10. The method according to claim 8, further comprising:

determining, by the controller, whether the engine is in a designated high load or high rotation state; and operating, by the controller, the oil pump to adjust the hydraulic pressure discharged from the oil pump to reach a pressure sufficient to open the second nozzle, and opening the jet control valve so that the piston cooling jet sprays the oil through both the first nozzle and the second nozzle, in response to determining that the engine is in the high load or high rotation state.

11. The method according to claim 8, further comprising:

determining, by the controller, whether a designated pause time elapses after the piston cooling jet sprays the oil during driving of the engine; and operating, by the controller, the oil pump and the jet control valve to cause the piston cooling jet to spray the oil through the first nozzle for a designated basic spray time, in response to determining that the pause time elapses.

* * * * *